US008265294B2

(12) United States Patent
Tjalsma et al.

(10) Patent No.: US 8,265,294 B2
(45) Date of Patent: Sep. 11, 2012

(54) PUBLIC ADDRESS SYSTEM UTILIZING POWER TRANSMISSION MEDIUM COMMUNICATION

(75) Inventors: Bertus Tjalsma, Rijen (NL); Alex Jonkman, Breda (NL)

(73) Assignee: Robert Bosch GmbH, Stuttgart (DE)

( * ) Notice: Subject to any disclaimer, the term of this patent is extended or adjusted under 35 U.S.C. 154(b) by 1201 days.

(21) Appl. No.: 11/575,088

(22) PCT Filed: Nov. 9, 2004

(86) PCT No.: PCT/EP2004/052880

§ 371 (c)(1),
(2), (4) Date: Mar. 12, 2007

(87) PCT Pub. No.: WO2006/050754

PCT Pub. Date: May 18, 2006

(65) Prior Publication Data

US 2008/0317252 A1 Dec. 25, 2008

(51) Int. Cl.
*H04R 27/00* (2006.01)
*H04R 29/00* (2006.01)

(52) U.S. Cl. ..... 381/82; 381/59

(58) Field of Classification Search ..... 381/82, 381/59, 58, 56, 77, 79
See application file for complete search history.

(56) References Cited

U.S. PATENT DOCUMENTS

| | | | | |
|---|---|---|---|---|
| 3,989,908 | A * | 11/1976 | Budrys et al. | 381/59 |
| 4,197,435 | A * | 4/1980 | Jackson et al. | 379/2 |
| 4,723,292 | A * | 2/1988 | Taylor | 381/56 |
| 5,345,510 | A * | 9/1994 | Singhi et al. | 381/77 |
| 7,197,148 | B2 * | 3/2007 | Nourse et al. | 381/82 |
| 2003/0063755 | A1 | 4/2003 | Nourse et al. | |
| 2004/0220687 | A1 | 11/2004 | Klotz et al. | |

FOREIGN PATENT DOCUMENTS

| | | |
|---|---|---|
| DE | 37 23 737 | 1/1988 |
| EP | 0 967 833 | 12/1999 |
| WO | 03/013041 | 2/2003 |

* cited by examiner

*Primary Examiner* — Hai Phan
(74) *Attorney, Agent, or Firm* — Michael J. Striker

(57) ABSTRACT

A public address system includes at least one monitoring device, a transmission medium and at least one level monitoring device. The monitoring device is connected to the transmission medium and powered by an AC voltage with a supply frequency present on the transmission medium. The monitoring device receives or transmits or transmits and receives a communication signal utilizing a carrier frequency upon the transmission medium. The carrier frequency is different from the supply frequency and the level monitoring device is adapted to monitor the level of the AC voltage.

16 Claims, 2 Drawing Sheets

PUBLIC ADDRESS SYSTEM UTILIZING POWER TRANSMISSION MEDIUM COMMUNICATION

BACKGROUND INFORMATION

This invention relates to a public address system, a control unit of a public address system and a monitoring device of a public address system.

Public address systems are sound systems informing and entertaining the public in buildings or public places, e.g. airports. In an event of emergency public address systems also warn the public. Public address systems consist of lines of loudspeakers and amplifiers. Monitoring the connection and correctness of one loudspeaker line from the amplifier to one end point of the loudspeaker line is required to meet the standard EN 60849 for voice evacuation systems. In current public address systems this is achieved for example by monitoring endpoints of loudspeaker lines by DC current through the wire or the shielding of the wire by sending continuously a unique signal back from one endpoint of the speaker line to the amplifier. Other examples are impedance measurement or monitoring with use of extra wiring.

ADVANTAGES OF THE INVENTION

The public address system, the control device of a public address system and the monitoring device of a public address system according to the independent claims have the advantage over the prior art that more than one endpoint per loudspeaker line can be monitored. The ability to have more than one endpoint in the loudspeaker wiring of a public address system makes installation easier and cheaper. A public address system, wherein the transmission medium (loudspeaker line) is branched, is particularly advantageous. Secondly the public address system, the control device of the public address system and the monitoring device of the public address system have the advantage of high accuracy. Furthermore no adaptation to the loudspeaker wiring is necessary. The claimed system and the devices work simultaneously with the audio distribution.

It is advantageous that monitoring of a great number of individual loudspeakers connected to one loudspeaker line without need of extra wiring is possible.

It is advantageous that the public address system further comprises at least one level monitoring device, wherein the level monitoring device is adapted to monitor the level of the AC voltage, for example the pilot tone (20 kHz AC voltage), because failures due to low power are recognised.

The control device is advantageous, because the control device creates the possibility for a local and general input and/or output on the loudspeaker line.

Polling the monitoring devices during audio distribution has the advantage that the status of the public address system, e.g. the status of the transmission medium and/or the loudspeakers, is monitored constantly. This leads to high reliability of the public address system. By polling the monitoring devices a number of times the level of detection reliability is increased.

Activating the transmitter of the monitoring device upon transmission has the advantage, that the power consumption of the monitoring device is low. In summary the monitoring device has the advantage of high power efficiency. Power efficiency is important, because all monitoring devices of the public address system are supplied from the pilot tone.

Further it is advantageous that the monitoring device comprises at least one power storage unit, especially at least one capacitor and/or at least one battery and/or at least one rechargeable battery, because in this case the power consumption of the monitoring device is distributed evenly.

Using a carrier frequency at 75 kHz has the advantage that 75 kHz is far from 60 kHz, because 20 kHz for power supply gives a 60 kHz component (third harmonic). Also the distance to the audio frequency range is large enough. On the other side 75 kHz is sufficiently low to avoid long line transmission problems. In summary a carrier frequency at 75 kHz has the advantage of a transmission range up to 1000 Meter with limited influence on the audio quality.

Using phase shift keying (PSK) modulation has the advantage of high power efficiency. With phase shift keying modulation high level of communication reliability is reached at a certain signal to noise distance.

In summary the public address system, the control device of the public address system and the monitoring device of the public address system have the advantage of high power efficiency. This is accomplished by activation of the transmitter upon transmission and the use of PSK modulation. Other features like passive filtering in order to prevent interference between audio, communication and supply and/or low power design of the PSK demodulator and/or use of lower power microprocessors with sleep mode and/or use of low leakage current components and/or use of a switched mode power supply for voltage conversion fulfil the requirement of high power efficiency.

Further advantages are derived from the features cited in the further dependent claims and in the description.

BRIEF DESCRIPTION OF THE DRAWINGS

An exemplary embodiment of the invention is shown in the drawing and described in further detail in the ensuing description.

DESCRIPTION OF THE EXEMPLARY EMBODIMENTS

A bi-directional communication with modulated data between a control device and a monitoring device and/or an end of line monitoring device is monitoring the presence and status of the loudspeaker line and loudspeakers constantly. The communication is frequency multiplexed upon the existing audio wire from the audio amplifier to the loudspeakers. In combination with the bi-directional data communication the power supply for the monitoring devices and/or the end of line monitoring devices is extracted from audio frequencies, in fact preferably a 20 kHz pilot tone generated by the audio amplifier. Passive filtering prevents interference between audio signals and/or communication signals and/or the power supply.

Figure 1:
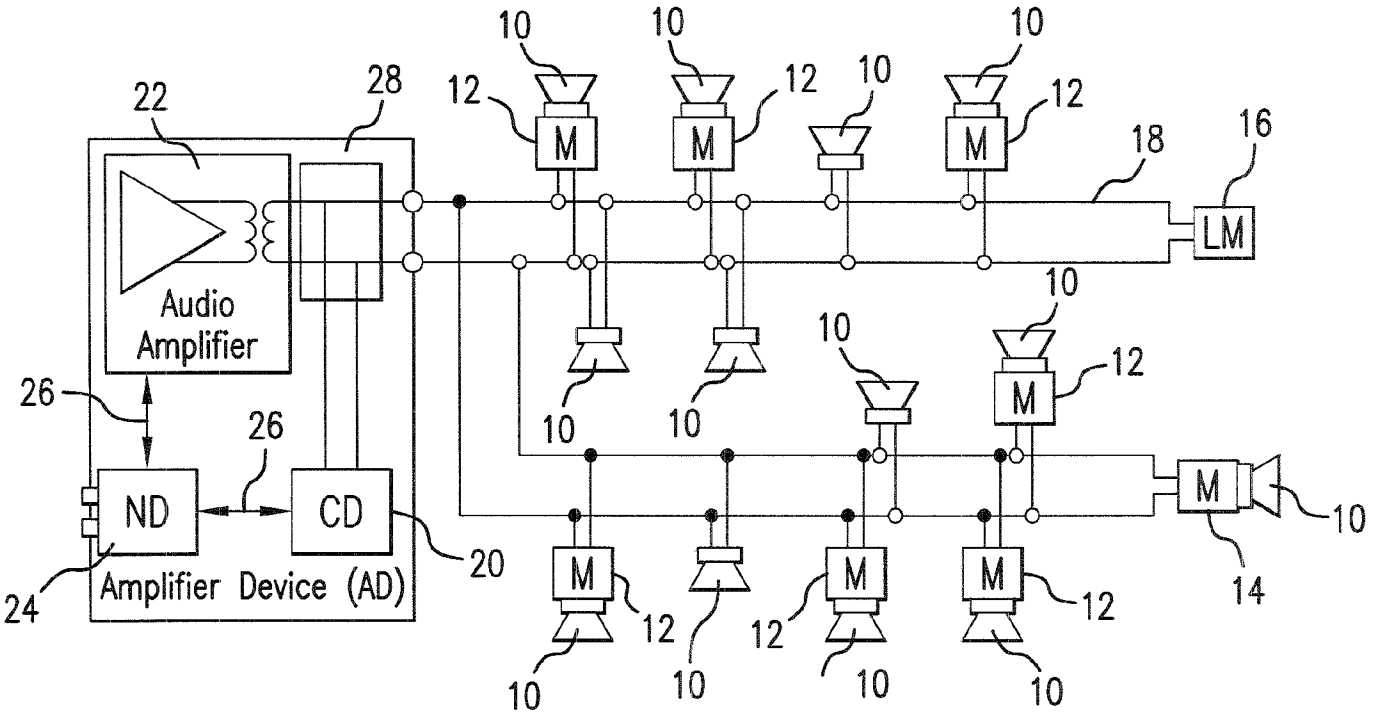
FIG. 1 shows a block diagram of the configuration of a public address system.

FIG. 1 shows a block diagram of the configuration of a public address system, comprising loudspeakers 10, monitoring devices (M) 12, a transmission medium 18 and a control device (CD) 20. The control device 20 is integrated into an amplifier device (AD) 28. The amplifier device 28 further comprises an audio amplifier 22 and a network device 24 (ND). Communication links 26 connect the network device 24 to the audio amplifier 22 and the control device 20. The control device 20 and the output of the audio amplifier 22 are connected to the transmission medium 18. In the preferred embodiment the transmission medium 18 is a wire or a cable.

The control device 20 controls all communication within the transmission medium 18 and also interfaces to the amplifier device 28 via an 12C interface. In the preferred embodiment the control device 20 is build in the amplifier device 28. The control device 20 is the master of the communication protocol. Every device, especially the monitoring devices (M) 12, 14 and/or the end of line monitoring devices (LD) 16, has its own unique address that is selected by the installer. The control device 20 polls all devices 12, 14, 16 to check if errors have occurred. Polling is an automatic, sequential testing of each connected device 12, 14, 16 in order to check its operational status. If a monitoring device 12, 14 and/or end of line monitoring device 16 responds, the device can report an error, especially a loudspeaker coil error and/or a power supply error and/or communication error and/or microprocessor error. If no error has occurred the monitoring device 12, 14 and/or end of line monitoring device 16 reports all is ok. If the monitoring device 12, 14 and/or end of line monitoring device 16 does not respond at all, it is assumed by the control device 20 that the device is malfunctioning or the transmission medium 18 is out of order. If an error occurs the control device 20 reports an error protocol to the network device 24. Each to be monitored loudspeaker 10 is associated with one monitoring device 12. In the preferred embodiment the public address system further comprises loudspeakers 12 not associated with a monitoring device. The function of the monitoring device 12 is to check if the loudspeaker coil is not an open connection. If an open connection is detected, the monitoring device 12 replies an error message to the control device 20. In the preferred embodiment the monitoring device 12 is powered by a 20 kHz pilot tone generated by the audio amplifier 22. The loudspeakers 10 are connected to the transmission medium 18 and the loudspeakers 10 receive audio frequencies within the audible frequency range, especially within the frequency range of 50 Hz to 18 kHz, from the audio amplifier 22. End of line monitoring of the transmission medium 18 is accomplished ether by a monitoring device 14 associated with a loudspeaker 10 and/or by an end of line monitoring device 16. The function of the monitoring device 14 and/or the end of line monitoring device 16 is to check if the transmission medium 18, e.g. the loudspeaker cable, is sill intact. If communication to the monitoring device 14 and/or the end of line monitoring device 16 fails, it is assumed by the control device 20, that the transmission medium 18 is out of order, e.g. the loudspeaker cable is broken or short-circuited. Therefore an end of line error is generated. In the preferred embodiment the end of line monitoring device 16 is powered by a 20 kHz pilot tone (AC voltage with a supply frequency preferably at 20 kHz) generated by the audio amplifier 22. In the preferred embodiment the monitoring devices 12, 14, 16 are polled a number of times, preferably between 5 and 10 times, to give every monitoring device 12, 14, 16 the possibility to response before it is assumed that a monitoring device 12, 14, 16 is not responding and conclude that the speaker line is out of order and/or a loudspeaker is disconnected and/or a loudspeaker coil is an open connection. This prevents reporting faulty errors to the network device 24.

Figure 2:
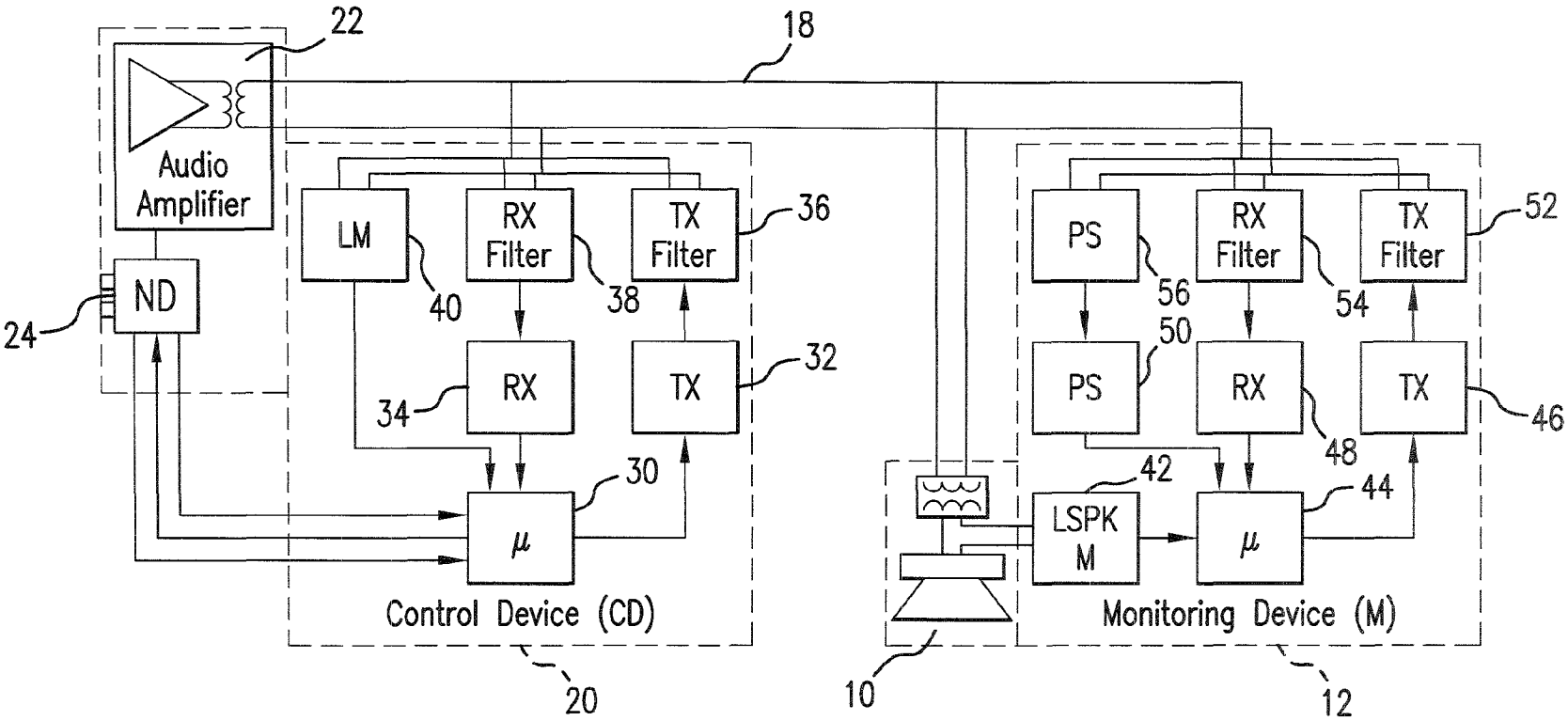
FIG. 2 shows a block diagram of the control device and the monitoring device.

FIG. 2 shows a block diagram of the monitoring device 12 and the control device 20. The monitoring device 12 is associated with a loudspeaker 10, whereas the control device 20 is associated with the audio amplifier 22 and the network device 24. The loudspeaker 10, the monitoring device 12, the control device 20 and the output of the audio amplifier 22 are connected to the transmission medium 18, wherein the transmission medium 18 in the preferred embodiment is a loudspeaker wire. The control device 20 comprises a microprocessor (μ) 30, a transmitter (TX) 32, a receiver (RX) 34, a filter of the transmitter (TX Filter) 36, a filter of the receiver (RX Filter) 38 and a level monitoring device (LM) 40. On the other side the monitoring device 12 comprises a loudspeaker monitoring device (LSPK M) 42, a microprocessor (μ) 44, a transmitter (TX) 46, a receiver (RX) 48, a power supply (PS) 50, a filter of the transmitter (TX Filter) 52, a filter of the receiver (RX Filter) 54 and a filter of the power supply (PS) 56. The microprocessor 44 of the monitoring device 12 controls the communication and supervises the loudspeaker 10. The power supply 50 of the monitoring device 12 or a power supply of the end of line monitoring device have got the two main functions. The first function is to convert the voltage from the power supply filter 56 to voltage levels used on the monitoring device 12, whereas the second function is to store energy during reception and deliver extra energy during transmission, because when the monitoring device 12 is not transmitting, the power consumption is low, whereas the power consumption increases during sending. To prevent varying load, a power storage unit is used to distribute the power consumption evenly. In the preferred embodiment the power storage unit is a capacitor. In the preferred embodiment this is achieved by delivering a constant power from the power supply filter 56. When the device is not transmitting, surplus power is stored in the capacitor, but when the device starts transmitting this stored power is used. Because the power supply is derived from a 20 kHz pilot tone, a filter of the power supply 56 takes care that all other signals, especially the audio signal and the communication signal, are not unnecessary loaded. The transmitter 46 of the monitoring device 12 encodes and modulates the data. A filter of the transmitter 52 processes the encoded and modulated data. The filter of the transmitter 52 comprises an amplifier, a transformer and a band-pass filter in order to superimpose the 75 kHz communication signal on the normal audio signals present on the transmission medium 18. The transmitter 46 is disconnected from the transmission medium 18 while no transmission takes place. Therefore only one transmitter 46 of all monitoring devices 12 is connected to the transmission medium 18 at the same time. The filter of the receiver 54 is a band-pass filter allowing 75 kHz communication signals passing the filter while other unwanted signals are attenuated. In order to prevent influencing the communication signal and/or the audio signal and/or the pilot tone of the power supply the input impedance of the filter of the receiver 54 is high. The receiver 48 itself demodulates and decodes the data and makes the data available to the microprocessor 44. Further the loudspeaker monitoring device 42 of the monitoring device 12 supervises the current through the coil of the loudspeaker 10. Because of the presence of the 20 kHz pilot tone a minimum current always flows through the coil of the loudspeaker 10. A too low level of this current is based on a fault of the loudspeaker 10 and this loudspeaker status is reported to the microprocessor 44 of the monitoring device 12. The microprocessor 30 of the control device 20 controls the communication, supervises the power supply and communicates with the network device 24. The control device 20 receives its power supply directly from the network device 24 and/or the amplifier device. The configuration and the function of the transmitter 32, the receiver 34, the filter of the transmitter 36 and the filter of the receiver 38 is almost the same as the transmitter 46, the receiver 48, the filter of the transmitter 52 and the filter of the receiver 54 of the monitoring device 12. Further the level monitoring device 40 measures the actual level of the AC power voltage, in the preferred embodiment the level of the 20 kHz pilot tone, and reports the measurements to the microprocessor 30. This level is depending on the load of the transmission medium 18 and varies in different installations and situations and is depending on used cable (wire) cable length, used type of loudspeakers 12 and the number of loudspeakers 12. In the preferred embodiment the microprocessor 30 of the control device 20 and/or the microprocessor 44 of the monitoring device are low power microprocessors with sleep mode and they are configured to sleep during no communication.

The communication between the control device and the monitoring devices of the loudspeakers and/or the end of line monitoring devices is done without installing extra wires (cables), because the only transmission medium is the loudspeaker cable. In order to minimise the influence on the audio quality the following communication topology for the communication signal is used. The carrier frequency is above the audible audio band, preferably between 55 kHz and 90 kHz. In the preferred embodiment the carrier frequency is at 75 kHz. Therefore the communication is inaudible. For transmission of communication data from the control device to and/or from the monitoring devices and/or the end of line monitoring devices in the preferred embodiment binary differential phase shift keying (DPSK) is used. "Binary" in binary DPSK stand for the possibility of only two different phases, −90° and +90°. PSK modulation is used for its best bit error rate versus signal to noise distance. Therefore less power is required to reach a certain bit error rate at a given noise level. DPSK is used because no carrier frequency is transmitted and no phase reference is available at a receiver. To overcome this problem differential coding is used. For demodulation differentially coherent demodulation is used. Further bi-phase coding (Manchester code) in the preferred embodiment is applied. Basically bi-phase coding overcomes the statistic data and timing problem by always having a transition at half the bit interval. A "1" is represented by high to low level change at mid clock, while a "0" is represented by a low to high level change at mid clock. This means that at midpoint there is always a transition and therefore synchronisation is maintained. In another embodiment bi-phase coding is used as a kind of error detection, because if no transition occurs at midpoint, an error has occurred.

In another embodiment the supply frequency of the AC voltage, the pilot tone, is outside the audible audio band and/or above 18 kHz and/or below 100 Hz including direct current (DC) voltage.

Furthermore, in another embodiment the level monitoring device, whereas the level monitoring device is adapted to monitor the level of the AC voltage (pilot tone), is a stand alone device and/or is within an audio amplifier.

In another embodiment besides checking for loudspeaker faults and/or loudspeaker cable faults the communication between the control device and the monitoring devices is used for general input and/or output control. Examples for a general input control are control of the volume ("volume control") and/or selection of background music ("background music selection"). Examples for a general output control are "volume override" and/or switching on/off of a warning indicator and/or a sign.

Furthermore, in another embodiment the power storage unit is at least one capacitor and/or at least one battery and/or at least one rechargeable battery.

The invention claimed is:

1. Public address system, comprising
at least one monitoring device,
a transmission medium,
at least one level monitoring device; and
a microprocessor that operates in an operational mode and in a sleep mode, wherein the microprocessor is programmed to operate in the sleep mode during a time in which there is no communication;
wherein the monitoring device is connected to the transmission medium, and is powered by an AC voltage with a supply frequency present on the transmission medium,
wherein the monitoring device receives or transmits or transmits and receives a communication signal utilising a carrier frequency upon the transmission medium,
wherein the carrier frequency is different from the supply frequency, and
wherein the level monitoring device is adapted to monitor the level of the AC voltage.

2. Public address system according to claim 1, characterised in that the public address system further comprises at least one loudspeaker, wherein the loudspeaker receives audio signals present on the same transmission medium.

3. Public address system according to claim 1, characterised in that the monitoring device is connected to at least one end of the transmission medium.

4. Public address system according to claim 1, characterised in that at least one loudspeaker line is the transmission medium.

5. Control device of a public address system according to claim 1, characterised in that the control device is adapted to poll the monitoring devices by receiving or receiving or transmitting and receiving the communication signal utilising the carrier frequency upon the transmission medium.

6. Control device according to claim 5, characterised in that the control device is adapted to poll the monitoring devices a number of times before the control device reports an error.

7. Monitoring device of a public address system according to claim 1, further comprising
at least one power unit, wherein the power unit is adapted to power the monitoring device by a AC voltage with a supply frequency present on a transmission medium, and
at least one receiver and/or at least one transmitter, wherein the receiver or the transmitter or the transmitter and the receiver are adapted to receive or transmit or transmit and receive a communication signal utilising a carrier frequency upon the same transmission medium, wherein the carrier frequency is different from the supply frequency.

8. Monitoring device according to claim 7, characterised in that the transmitter transmits status information of the monitoring device or the loudspeaker or the monitoring device and the loudspeaker.

9. Monitoring device according to claim 7, characterised in that the transmitter is activated upon transmission.

10. Monitoring device according to claim 1, further comprising at least one power storage unit, wherein the power storage unit is preferably at least one capacitor or at least one battery or at least one capacitor and at least one battery, wherein the at least one battery may comprise at least one rechargeable battery.

11. Monitoring device according to claim 1, characterised in that the monitoring device is associated with at least one loudspeaker, wherein the monitoring device monitors the functioning of the loudspeaker, especially by supervising a current through at least one coil of the loudspeaker.

12. Monitoring device according to claim 1, characterised in that the supply frequency is at least one of the group consisting of: above 18 kHz, below 100 Hz, above 18 kHz and below 100 Hz, above 18 kHz and direct current (DC), and below 100 Hz and direct current (DC).

13. Monitoring device according to claim 1, characterised in that the carrier frequency is above the audible audio band, especially at 75 kHz.

14. Monitoring device according to claim 1, characterised in that the communication signal is a phase shift keying (PSK) modulated signal, especially a differential phase shift keying (DPSK) modulated signal or a binary differential phase shift keying (binary DPSK) modulated signal.

15. Monitoring device according to claim 1, characterised in that the communication signal contains biphase coded data.

16. Monitoring device according to claim 1, characterized in that the supply frequency includes 20 kHz and direct current (DC).

* * * * *